United States Patent [19]

Cutshall et al.

[11] Patent Number: 4,784,733

[45] Date of Patent: Nov. 15, 1988

[54] RECYCLING OF SPENT POTLINER

[75] Inventors: Euel R. Cutshall, Tuscumbia; Luther O. Daley, Lauderdale County, both of Ala.

[73] Assignee: Reynolds Metals Company, Richmond, Va.

[21] Appl. No.: 124,221

[22] Filed: Nov. 23, 1987

[51] Int. Cl.[4] ..... C25C 3/06

[52] U.S. Cl. ..... 204/67; 204/294; 313/327; 373/89

[58] Field of Search ..... 204/67, 294; 313/327; 373/89

[56] References Cited

U.S. PATENT DOCUMENTS

| | | | |
|---|---|---|---|
| 167,986 | 7/1875 | Burgess | 423/111 |
| 2,645,583 | 7/1953 | Stanko | 106/56 |
| 2,653,878 | 9/1953 | Sejersted et al. | 106/56 |
| 2,732,283 | 1/1956 | Clukey | 423/116 |
| 3,635,408 | 1/1972 | Williams | 241/1 |
| 3,932,244 | 12/1973 | Mikkelsen | 156/71 |

FOREIGN PATENT DOCUMENTS

| | | | |
|---|---|---|---|
| 155230A | 7/1984 | European Pat. Off. | 204/294 |

OTHER PUBLICATIONS

Belitskus, "Effects of Butt Content, Green Scrap, and Used Potlining Additions on Bench Scale Prebaked Anode Properties", Light Metals, 1980, AIME, N.Y., pp. 431–442.

Cutshall, Euel R. and Daley, Luther O., "Spent Potlining Carbon in Soderberg Anodes," paper presented at 1986 AIME Convention, Mar. 2–6, 1986, New Orleans, La.

Krzemien, Eugeniusz, Sucharek, Zbegniew and Orzechowski, Stanislaw, "Possibilities for the Utilization of Spent Cathode Blocks," Rudy Metale Niezalaz, 18(1), pp. 541–544, 1973.

*Primary Examiner*—John F. Niebling
*Assistant Examiner*—Kathryn Gorgos
*Attorney, Agent, or Firm*—Alan T. McDonald

[57] ABSTRACT

A method is disclosed for recycling spent potliner carbon from an aluminum reduction cell. The spent potliner is treated so as to avoid the cracking problem normally seen when the potliner is used in substantial amounts in Soderberg anodes.

5 Claims, No Drawings

RECYCLING OF SPENT POTLINER

BACKGROUND OF THE INVENTION

Aluminum metal is produced in reduction cells by the Hall-Herolt process by reducing alumina electrolytically with cryolite. The cells in which this process is performed are lined with carbon, with the carbon lining forming the cathode for the process.

During the campaign of a reduction cell, this potliner carbon becomes contaminated with numerous materials, including cryolite, alumina, aluminum, sodium, sodium oxide, sodium carbonate, sodium hydroxide, sodium fluoride, aluminum nitride and aluminum carbide. When the cell is rebuilt, this potliner carbon is removed, with the removed material being identified as spent potliner.

At one time, it was considered common practice to discard this spent potliner as waste. However, in order to increase the economics of the reduction process, it has become increasingly important to recover and recycle this material.

It is known that spent potliner can be crushed and mixed with carbonaceous aggregate and pitch to form a paste, with this paste being employed as the anode of a Soderberg reduction cell. In a Soderberg cell, the anode is constantly being consumed at its bottom within the molten alumina-cryolite bath and at the same time is being replenished by additions of anode paste at its top. Over time, the anode paste is heated and baked such that by the time it reaches its working position at the bottom of the cell, it has become a solid monolith.

Unfortunately, it has been found that if an amount greater than about 5 to 10% of the total aggregate is replaced by untreated spent potliner, the resulting baked carbon anode tends to have a structure containing numerous cracks and does not have sufficient mechanical strength for use as a Soderberg anode.

It has also been attempted to replace up to 25% of the total aggregate with spent potliner in forming a Soderberg anode. However, in this case, it was found that the anode was consumed during electrolysis at a greater than normal rate.

Thus, previous attempts to utilize spent potliner as a feed stock for Soderberg anodes have met with little success. It remains desirable, however, to replace as much of the carbonaceous aggregate in a Soderberg anode paste with spent potliner as possible, for obvious economic reasons.

THE PRESENT INVENTION

By means of the present invention, increased spent potliner utilization in a Soderberg anode paste can be realized. According to the method of the present invention, either (1) the aluminum nitride or aluminum carbide contaminates in the spent potliner are decomposed prior to mixing the spent potliner and the carbonaeous aggregate with pitch to form an anode paste, or (2) all moisture is removed from the spent potliner so that its destructive reactions with aluminum carbide and aluminum nitride cannot take place. With the treated spent potliner available as a feed source, up to 50% of the carbonaceous aggregate may be replaced with the spent potliner, making its use as a Soderberg anode paste component more attractive.

DETAIL DESCRIPTION OF THE PREFERRED EMBODIMENTS

It has been determined that the cracking of Soderberg anodes which include spent potliner as a portion of the carbonaceous aggregate results from the moisture adsorbed on the spent potliner and subsequent reaction with the aluminum carbide and aluminum nitride components thereof. Thus, in order to successfully utilize spent potliner in a Soderberg anode, the harmful effects of these materials must be eliminated.

Several of the sodium compounds contained in the spent potliner (Na metal, $Na_2O$ and NaOH) result in the potliner having moisture adsorbed upon and within its mass. Unless this moisture is removed from the spent potliner prior to it being mixed with carbon aggregate and pitch to form Soderberg paste, the cracked structure of the carbon, as mentioned previously, results. The moisture forms a barrier on the spent potliner which does not allow proper bonding to take place as the pitch and carbon aggregate are mixed. Once the paste is added to the top of a Soderberg anode, it is slowly reheated. The pitch becomes fluid once again and, as the temperature rises, the moisture reacts with the contained aluminum carbide and aluminum nitride according to the equations below:

$$Al_4C_3 + 6H_2O \rightarrow 2Al_2O_3 + 3CH_4$$
$$2AlN + 3H_2O \rightarrow Al_2O_3 + 2NH_3$$

Methane and ammonia are formed and, since they are in the gaseous state, create additional stresses within the carbon structure and, thereby, further degrade the bond between the pitch and the aggregate. As the temperature rises further, the pitch carbonizes and shrinks. The lack of a proper bond between pitch and aggregate results in the cracked structure.

In order to eliminate this cracking problem, there are three options.

(1) According to the first embodiment of the invention, the spent potliner is exposed to naturally occurring atmospheric humidity for a period of two months or more prior to its being mixed with petroleum coke aggregate and pitch. This exposure allows all contained sodium compounds to fully react with the moisture and carbon dioxide contained in the atmosphere to form sodium carbonate and bicarbonate. At this point, moisture which can degrade the bond between pitch and aggregate is no longer adsorbed on the outside surface of the potliner. Also, during this two-month period, aluminum carbide and aluminum nitride fully react with the moisture and can no longer weaken the pitch-aggregate bond.

(2) According to the second embodiment of the invention, the spent potliner is preheated either in the carbon paste mixer or a separate vessel to a temperature between about 110° and 180° C., either with or without the petroleum coke aggregate prior to pitch additions. Again, this removes the moisture before it is trapped by the pitch to later react with the aluminum carbide and aluminum nitride and cause the cracking.

(3) According to the third embodiment of the invention, the spent potliner is exposed to steam. The potliner is placed in a vessel which can withstand internal pressures of at least about 1 atmosphere and is preheated to at least about 100° C. Steam is introduced into the vessel and the aluminum carbide and aluminum nitride fully react according to the equations previously given. The potliner is dried in the same vessel and is then ready for use in the carbon paste.

Note that for all three embodiments, it is assumed that the potliner is stored in some kind of enclosed building and not exposed to rainfall.

In each of the above embodiments, up to about 50% of the petroleum coke aggregate may be substituted by spent potliner which has been treated either prior to or during the mixing of the spent potliner and aggregate.

With the treated spent potliner present, the pitch can adequately wet the aggregate surfaces of both the petroleum coke and the spent potliner such that proper carbon bonds will form once the paste is baked. The hydrolysis of $Al_4C_3$ and AlN cannot occur because the spent potliner has been pre-hydrolyzed and/or the water has been removed. Cracking is eliminated or reduced substantially.

From the foregoing, it is clear that the present invention provides a simple, yet effective procedure for permitting substantial substitution of spent potliner into Soderberg anode paste.

While the invention has been described with reference to certain specific embodiments thereof, it is not intended to be so limited thereby, except as set forth in the accompanying claims.

We claim:

1. A method for replenishing an anode for use in a Soderburg alumina reduction cell comprising mixing spent potliner, petroleum coke and pitch to form a paste, positioning said paste on top of said anode and baking said anode during operation of said cell wherein the improvement comprises subjecting said spent potliner to naturally occurring atmospheric humidity for a period of at least about two months prior to said mixing to thereby permit an amount up to about 50% of the sum of spent potliner and petroleum coke present in said paste to be spent potliner while preventing or reducing substantially cracking of said anode.

2. A method for replenishing an anode for use in a Soderburg alumina reduction cell comprising mixing spent potliner, petroleum coke and pitch to form a paste, positioning said paste on top of said anode and baking said anode during operation of said cell wherein the improvement comprises heating said spent potliner to a temperature between about 100° and 180° C. to remove moisture therefrom prior to said mixing to thereby permit an amount up to about 50% of the sum of spent potliner and petroleum coke present in said paste to be spent potliner while preventing or reducing substantially cracking of said anode.

3. The method of claim 2 wherein said spent potliner is heated prior to mixing with said petroleum coke and said pitch.

4. The method of claim 2 wherein said spent potliner and said petroleum coke are mixed and heated together prior to mixing with said pitch.

5. A method for replenishing an anode for use in a Soderburg alumina reduction cell comprising mixing spent potliner, petroleum coke and pitch to form a paste, positioning said paste on top of said anode and baking said anode during operation of said cell wherein the improvement comprises heating said spent potliner to a temperature of at least about 100° C., exposing said spent potliner to steam and drying said spent potliner prior to said mixing to thereby permit an amount up to about 50% of the sum of spent potliner and petroleum coke present in said paste to be spent potliner while preventing or reducing substantially cracking of said anode.

* * * * *